United States Patent [19]

Steiger

[11] 4,215,991

[45] Aug. 5, 1980

[54] PROCESS FOR PRODUCING CLOQUÉ OR UNDULATING EFFECTS ON THE SURFACES OF TEXTILE FABRICS

[75] Inventor: Alfred Steiger, Wattwil, Switzerland

[73] Assignee: Heberlein Textildruck AG, Wattwil, Switzerland

[21] Appl. No.: 16,383

[22] Filed: Mar. 1, 1979

[30] Foreign Application Priority Data

Mar. 3, 1978 [CH] Switzerland ..... 2322/78

[51] Int. Cl.[2] ..... D06Q 1/02

[52] U.S. Cl. ..... 8/115

[58] Field of Search ..... 8/115

[56] References Cited

U.S. PATENT DOCUMENTS

| | | | |
|---|---|---|---|
| 2,244,767 | 6/1941 | Corbett et al. | 8/115 |
| 2,382,416 | 8/1945 | Heberlein et al. | 8/115 |
| 2,776,868 | 1/1957 | Russell et al. | 8/115 |

*Primary Examiner*—Joseph L. Schofer
*Assistant Examiner*—Herbert J. Lilling
*Attorney, Agent, or Firm*—Larson, Taylor and Hinds

[57] ABSTRACT

A process is disclosed for producing cloqué or undulating effects on the surfaces of textile fabrics made from synthetics, in which process the fabric is subjected to a first heat-treatment at temperatures varying between 100° C. and 200° C. with tension or pressure being applied, e.g. hot calendering or stentering, for the purpose of temporarily increasing the density of the threads in the fabric. Following this, the fabric is printed with a heat-resistant resist to the specifications of a pattern, and subjected to a second heat-treatment at temperatures varying between 100° C. and 200° C., preferably without tension, for 30 seconds to 10 minutes for the purpose of decreasing the density of the threads in those areas not printed with the resist paste. The resist is removed by washing, the fabric being dried by conventional means.

7 Claims, No Drawings

PROCESS FOR PRODUCING CLOQUE OR UNDULATING EFFECTS ON THE SURFACES OF TEXTILE FABRICS

FIELD OF THE INVENTION

The present invention relates to a process or processes for producing cloqué or undulating effects on the surfaces of textile fabrics made from synthetic fibres.

BACKGROUND AND SUMMARY

The production of areas of partial shrinkage and undulation on textile fabrics containing synthetic fibres by the local application of organic agents causing the synthetic fibres to swell and by the ensuing shrinkage of the synthetic fibres by thermal action is well-known, versions of which are sometimes referred to as "Plissé printing." For instance, a method has been proposed whereby areas of partial shrinkage are produced on fabrics of polyester fibres by the application of printing pastes containing phenol and ensuing thermal treatment at approximately 120° C., during which the printed areas are caused to shrink, thereby imparting an undulating effect to the unprinted areas.

A further method is known to the trade whereby woven or knitted fabrics containing at least a proportion of polyamide fibres are first printed with a resist paste to the specification of the pattern and treated with a solution of swelling agents, such as formic, acetic or halogenated acetic acid, following which they are removed by washing with water and dried. The areas containing the resist paste show an insulating effect, whereas the other areas remain totally flat.

These known processes have a number of shortcomings, one being that the areas treated with the swelling agent frequently show signs of stiffness and hardness; the other, that synthetic fibres treated with swelling agents invariably behave like undrawn fibres owing to their high degree of swelling and exhibit increased stretching particularly apparent when the garment manufactured from these fibres is laundered or worn.

A further handicap, of a more serious nature, is that the swelling agents applied diffuse only very slowly into the liquor in the ensuing washing operation to which the woven and knitted fabrics are subjected, some always remaining in the fibre for all practical purposes, thereby easily causing dermatological problems. Moreover, as many of the swelling agents applied are sensitive to light, the woven or knitted fabrics treated practically always show signs of yellowing, which are more or less pronounced. Finally, the vaporization or sublimation of the swelling agents applied represent a hazard during the drying operation and should not be discounted from an ecological viewpoint.

The object of the invention is to remove the known shortcomings and to devise a simple, readily reproducible method of producing pronounced cloqué or undulating effects of a permanent, uniform nature. This requirement is met in the invention by carrying out a first heat-treatment preferably in a calendering operation, for example, friction calendering with the surface temperatures of the rolls ranging between 100° C. and 200° C., for temporarily increasing the density of the threads in the fabric. The first heat-treatment may also be carried out with the fabric under tension, for example, on a stenter for a period of 30 to 60 seconds. Following this, the fabric is printed with a heat-resistant resist to the specifications of a pattern, followed by a second heat-treatment preferably carried out without tension for a period of 30 seconds to 10 minutes for decreasing the density of the threads in those areas not printed with the resist paste.

The effectiveness of the new process is remarkable because it would not be expected in the trade that the heat-treatment alone would produce pronounced shrinkage of a uniform nature in those areas of a fabric not printed with a resist paste. The principal advantage of the process invented is that it does not require the application of chemical agents that are hazardous from toxicological and ecological viewpoints or the use of specialized equipment. As opposed to coventional processes, the shrinkage effects that are achieved in the process invented are basically more resistant to modern care requirements; i.e., they show increased stability towards laundering and dry cleaning. Furthermore, they are able to withstand mechanical strain as long as the tensile strength of the untreated woven or knitted fabric is not exceeded. Suited as base materials for the process invented are fabrics woven or knitted from continuous-filament yarns, preferably textured yarns, or staple yarns. These are formed from synthetic fibres, such as polyester, polyamide, or polyacrylonitrile.

Printing pastes in the form of aqueous solutions are primarily suited to producing resists capable of withstanding high temperatures. Solutions in organic solvents, dispersions or emulsions may also be employed. The printing pastes consist of thickeners made from natural products, such as alginates, starches, especially those starches derived by retting, hydrolysis or chemical modification, for example. Furthermore, water-soluble cellulose or galactomannan derivatives may be employed. In addition, natural plant gums, such as tragacanth and gum arabic and, last but not least, 100% synthetic water-soluble high-grade polymers, such as polyvinyl alcohol and salts of polyacrylic acid, are suitable.

When the first heat-treatment consists of friction-calendering operations, the cloqué or undulating effects may be combined with lustrous or mat effects. These effects may be produced on a white, dyed or printed fabric. The resist pastes may also be applied, with accurate registration, in conjunction with a color print, whether by conventional printing methods or discharge printing, whereby the areas showing the undulating effect also exhibit the ground color. Finally, the areas showing the undulating effect may also be dyed or discharge printed by adding colors and/or discharge agents to the resist paste.

DESCRIPTION OF PREFERRED EMBODIMENTS

The invention is described in detail below, being illustrated by a number of examples.

EXAMPLE 1

After being degreased, thermofixed, and dyed pink, a raschel jersey having a weight of 125 g/sq.m. made from textured polyester yarns of 84 and 167 dtex, was friction-calendered, with a linear pressure of 40 tons being applied. The surface temperature of the metal rolls was 170° C. with friction being set at 100%.

On a flat screen-printing machine a 50% solution of dextrin was applied to the knitted fabric with a screen to the specification of the pattern, and dried at 170° C. in a drying loft for 3 minutes. To remove the dextrin applied by printing, the knitted fabric was washed in warm water at 60° C. and given a cold rinse. After spin-drying and scutching, the raschel jersey was dried on a pin stenter set at a moderate width and running at 10% overfeed.

The treated knitted fabric presents a localized undulating effect in combination with lustrous/mat effects showing good stability towards laundering.

EXAMPLE 2

A woven fabric having a twill weave and 53/45 picks and ends per cm and made of textured polyester continuous-filament yarns of 50 dtex in warp and weft was pre-treated, dyed black by the Thermosol method and thermofixed at the same time. After conventional washing and drying on a stenter frame, the woven fabric underwent hot calendering with a linear pressure of 1 ton being applied, the metal rolls being heated to 120° C.

The application of a resist paste consisting of a 40% aqueous solution of gum arabic was carried out by circular screen printing to the specifications of the pattern, subsequent drying taking place at 130° C. Following this, the woven fabric was maintained at a temperature of 170° C. in a short-loop dryer for 10 minutes. Washing was carried out without tension in an open-width washer, final stentering being as described in Example 1.

The woven fabric treated exhibits a localized cloque effect pleasing to the eye and of a permanent nature.

EXAMPLE 3

The woven fabric described in Example 2 was pretreated, optically brightened and thermofixed. Following this, it underwent hot calendering as described in Example 2. A two-screen design was applied by circular screen-printing, the first operation consisting of printing a mixture of a black disperse color; the second, applying the resist paste as described in Example 2 with the second screen registering completely. Drying took place at 130° C. Following this treatment, the color applied with the resist paste in this case required special fixation at 185° C. in a high-pressure steamer for 5 minutes, the desired cloqué effects developed at the same time during this operation.

Final washing was carried out in a tank, being preceded by a warm wash, a reduction treatment with caustic soda/hydrosulphite at 50° C. and one warm and one cold rinse in pure water until free of alkali. The resist paste applied was completely removed by washing at the same time. The result of the treatment is that a very pleasing cloqué effect showing excellent stability is developed, being enhanced by the accompanying color patterns.

EXAMPLE 4

The woven fabric described in Example 2 was color printed and finished. The first heat-treatment was carried out on a pin stenter at 160° C. with moderate tension being applied for 30 seconds.

The resist paste was applied by circular screen-printing as described in Example 2, an aqueous solution containing 30 g sodium alginate per kg being employed as the printing paste. Drying took place at 100° C.

The cloqué effect was developed on a stenter frame with overfeed at 170° C. for 30 seconds. Further treatments were carried out as specified in Example 2.

The result was a cloqué effect superimposed on the color print showing excellent stability towards laundering.

EXAMPLE 5

A knitted fabric having an interlock construction and made from textured polyester yarns of 75 dtex was pretreated on a jet-dying machine, dyed to a light blue and subjected to a heat treatment as described in Example 2.

A flat screen-printing process was employed to print a design containing sharp outlines, the color consisting of crystal gum to which 8% of a commercial variety of blue disperse color was added. Subsequent drying took place in a drying loft at 140° C. For fixation of the blue color and development of the cloqué effect, the fabric was treated at 170° C. in a high-pressure ager for 8 minutes and washed at 50° C. on a winch, subjected to a reduction treatment with caustic soda/hydrosulphite and rinsed again.

The result was a cloqué effect pleasing to the eye and showing stability towards laundering.

EXAMPLE 6

A woven fabric having a crepe weave with 46/36 picks and ends per cm and made from textured continuous-filament polyester was pretreated in its grey state and subjected to friction calendering at 170° C. with friction being set at 100% and a pressure of 20 tons being applied. Following this, the fabric was padded with a 15% solution of a dischargeable disperse navy blue 2R-PC paste (C.I. disperse blue 285) and 1% sodium alginate and carefully dried at 120° C. Fixation of the dye was not carried out at this stage.

Printing was carried out by circular screen printing employing three screens to produce the pattern. One of the three screens was employed to apply a resist paste consisting of 40 parts of hydrolyzed starch and 60 parts of water; the remaining two screens were employed to apply a color-free resist paste containing 6% soda and a color resist containing 6% soda and 5% a resistant blue disperse color. Drying took place at 130° C. in the drying loft.

Fixation of the colors and development of the cloqué effect were carried out at a temperature of 160° C. in a high temperature ager for a period of 10 minutes. This was followed by washing, a reduction treatment and final rinsing.

The woven fabric thus treated showed a tone-on-tone cloqué effect on the navy-blue ground, together with additional contrasting lustrous/mat effects, having white and light-blue pattern areas.

EXAMPLE 7

A white knitted fabric having an interlock construction and made of polyester was friction-calendered at 200° C. with friction being set at 200% and a pressure of 10 tons being applied.

The resist paste was applied by circular screen printing, an aqueous solution containing 20% of a chemically modified starch being employed. Subsequent drying was carried out at 120° C. in a drying loft, the cloqué effect being developed by stentering at 170° C. for 30 seconds. After removing the resist by a warm wash on a jet drying machine, the knitted fabric was dyed red, disperse dyes being used. A tone-on-tone cloqué effect was produced, having good stability towards laundering.

EXAMPLE 8

A woven fabric made from spun polyester staple and having a surface weight of 80 g/m$^2$ was subjected to a preliminary treatment comprising a printing operation and thermofixed. At the same time thermofixation served to increase the density of the knitted fabric; the operation was carried out at 200° C. for 30 seconds with moderate tension in warp and weft.

Following this, a roller-printing process was employed to apply a resist paste consisting of a 5% solution of a chemically modified starch. Drying took place at 100° C. in a drying loft. The cloqué effect was developed at 200° C. in a festoon dryer for 4 minutes.

Following this, the resist paste was removed by a warm wash, the woven fabric dried on a stenter and printed with pigments by roller printing and fixed at 150° C. for 3 minutes.

The resulting woven fabric showed undulating effects not registering with the pattern of the subsequent color print.

EXAMPLE 9

A sheer fabric having 42/36 picks and ends per cm and woven from smooth nylon 6.6 was, after being dyed green, subjected to friction calendering as described in Example 7 and printed with a resist paste consisting of a 40% solution of ethyl cellulose in isopropanol, dried and stentered at 170° C. for 30 seconds to develop the cloqué effect. After development, the resist was removed in a dry-cleaning drum using perchloroethylene.

The result was a tone-on-tone cloqué effect showing good stability towards laundering.

EXAMPLE 10

A taffeta fabric made from smooth polyacrylic continuous-filament yarn was, after being dyed yellow, subjected to hot calendering as described in Example 1 and printed with a dextrin resist to the specifications of the pattern, treated at 170° C. in the drying loft for 3 minutes, removed by washing and dried.

The fabric presented a localized cloqué effect showing good stability towards laundering.

Having thus described my invention, including preferred embodiments thereof, I claim:

1. Process for producing cloqué or undulating patterns on the surfaces of textile fabric made from synthetic fibres, comprising subjecting the fabric to a first heat-treatment at temperatures between 100° C. and 200° C. with tension and/or pressure being applied for temporarily increasing the density of the fibres in the fabric, applying a resist paste capable of withstanding high temperatures to the specifications of a pattern, subjecting the fabric to a second heat-treatment at temperatures ranging between 100° C. and 200° C. to decrease the density of the threads in those areas not printed with resist paste, and washing and drying the fabric.

2. Process as claimed in claim 1 wherein the first heat-treatment comprises a calendering operation with the surface temperatures of the calender rolls being between 100° C. and 200° C.

3. Process as claimed in claim 2 wherein the first heat-treatment comprises friction calendering.

4. Process as claimed in claim 1 wherein in the first heat-treatment the fabric is heat-treated under tension for 30 to 60 seconds.

5. Process as claimed in claim 1 wherein in the second heat-treatment the fabric is heat-treated without tension for 30 seconds to 10 minutes.

6. Process as claimed in claim 1 wherein the resist paste is a printing paste in the form of an aqueous solution.

7. Process as claimed in claim 1 wherein the resist paste is of the group consisting of solutions in organic solvents, dispersions or emulsions, for producing resists capable of withstanding high temperatures.

* * * * *